US012290716B2

(12) United States Patent
Cuadrado et al.

(10) Patent No.: US 12,290,716 B2
(45) Date of Patent: May 6, 2025

(54) TONGUE STRENGTHENING DEVICE

(71) Applicant: The Regents of the University of Colorado, Denver, CO (US)

(72) Inventors: Elizabeth Cuadrado, Denver, CO (US); Aaron Treat, Denver, CO (US); Joshua W. Morrison, Denver, CO (US); Robert Elliott, Highlands Ranch, CO (US)

(73) Assignee: The Regents of the University of Colorado, Denver, CO (US)

( * ) Notice: Subject to any disclaimer, the term of this patent is extended or adjusted under 35 U.S.C. 154(b) by 156 days.

(21) Appl. No.: 18/206,022

(22) Filed: Jun. 5, 2023

(65) Prior Publication Data

US 2023/0390602 A1 Dec. 7, 2023

Related U.S. Application Data

(60) Provisional application No. 63/349,478, filed on Jun. 6, 2022.

(51) Int. Cl.

| | |
|---|---|
| ***A63B 23/03*** | (2006.01) |
| ***A63B 21/00*** | (2006.01) |
| ***A63B 21/008*** | (2006.01) |

(52) U.S. Cl.
CPC ..... *A63B 23/032* (2013.01); *A63B 21/0004* (2013.01); *A63B 21/0085* (2013.01); *A63B 21/4035* (2015.10)

(58) Field of Classification Search
CPC ..... A63B 21/4003; A63B 21/00047; A63B 21/00189; A63B 21/028
See application file for complete search history.

(56) References Cited

U.S. PATENT DOCUMENTS

| | | | | |
|---|---|---|---|---|
| 6,607,549 | B2 * | 8/2003 | Huang | A63B 23/032 606/234 |
| 2007/0037665 | A1 * | 2/2007 | Robbins | A63B 21/0004 482/11 |
| 2015/0282798 | A1 * | 10/2015 | Uphoff | A63B 23/032 433/140 |

* cited by examiner

*Primary Examiner* — Zachary T Moore
(74) *Attorney, Agent, or Firm* — Snell & Wilmer, L.L.P.

(57) ABSTRACT

Disclosed is a tongue strengthening device that includes a handle on one end and a bulb structure on the other end. The bulb is resiliently flexible, and enables a user to exercise their tongue by repeatedly compressing and releasing the bulb. Provided is a system or kit that includes multiple tongue strengthening devices having different compression specifications that allow a patient to graduate to devices which are harder to compress as the patient gains tongue strength.

13 Claims, 7 Drawing Sheets

TONGUE STRENGTHENING DEVICE

CROSS REFERENCE TO RELATED APPLICATIONS

This application claims priority to U.S. provisional patent application Ser. No. 63/349,478, the contents of which are incorporated by reference in its entirety.

BACKGROUND

A variety of illnesses, including stroke, cancer, and neurodegenerative diseases, can cause oral weakness. When the tongue becomes too weak to support adequate nutrition, alternatives such as feeding tubes are often used.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein without departing from the spirit and scope of the disclosure. Thus, the detailed description herein is presented for purposes of illustration only and not of limitation.

As used herein, the terms "including," "comprising," "having," and variations thereof mean "including but not limited to" unless expressly specified otherwise. Accordingly, the terms "including," "comprising," "having," and variations thereof are intended to cover a non-exclusive inclusion, such that a process, method, article, or apparatus that comprises a list of elements does not include only those elements but may include other elements not expressly listed or inherent to such process, method, article, or apparatus. An enumerated listing of items does not imply that any or all of the items are mutually exclusive and/or mutually inclusive, unless expressly specified otherwise.

Further, in the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Thus, when a particular feature, structure, or characteristic is described in connection with an embodiment, it is submitted that it is within the knowledge of one skilled in the art to affect such feature, structure, or characteristic in connection with other embodiments whether or not explicitly described. Similarly, the use of the term "implementation" means an implementation having a particular feature, structure, or characteristic described in connection with one or more embodiments of the present disclosure. Absent an express correlation to indicate otherwise, an implementation may be associated with one or more embodiments. After reading the description, it will be apparent to one skilled in the relevant art(s) how to implement the disclosure in alternative embodiments.

Figure 1:
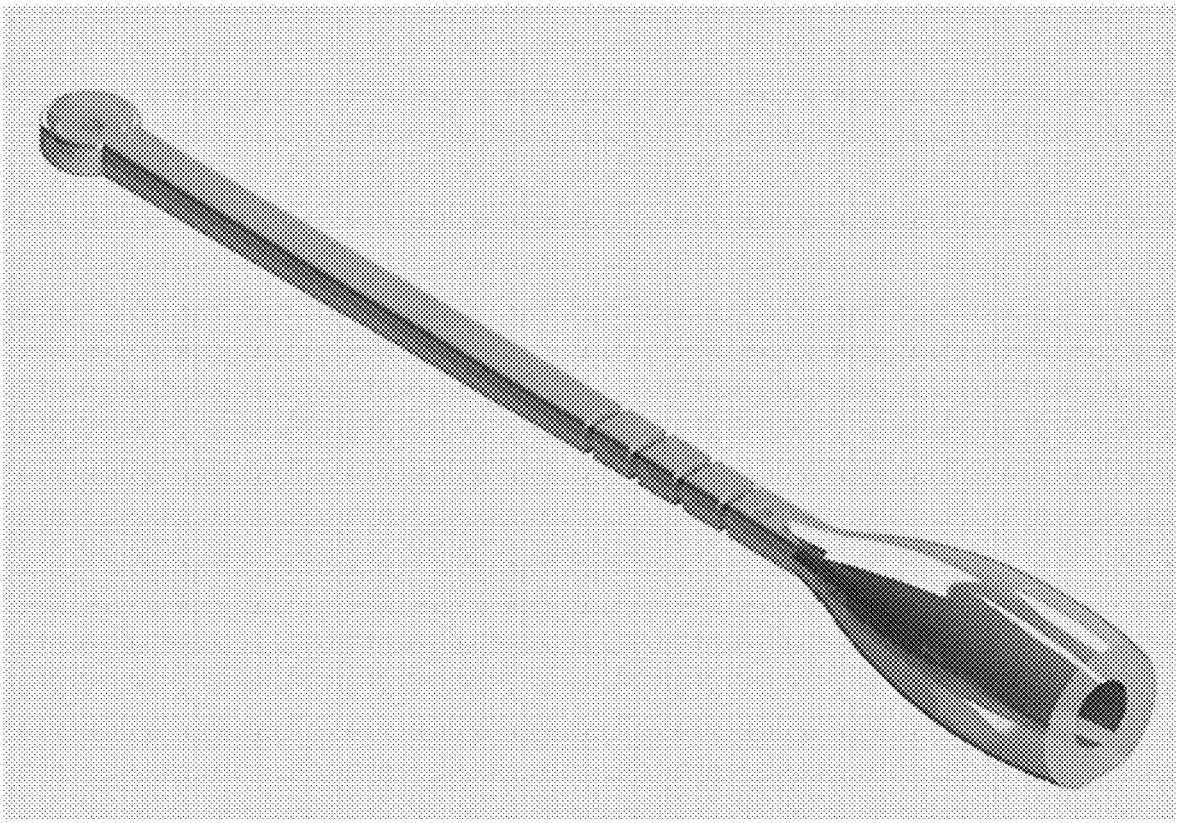
FIG. 1 shows an embodiment of the tongue strengthening device disclosed herein.
Figure 2:
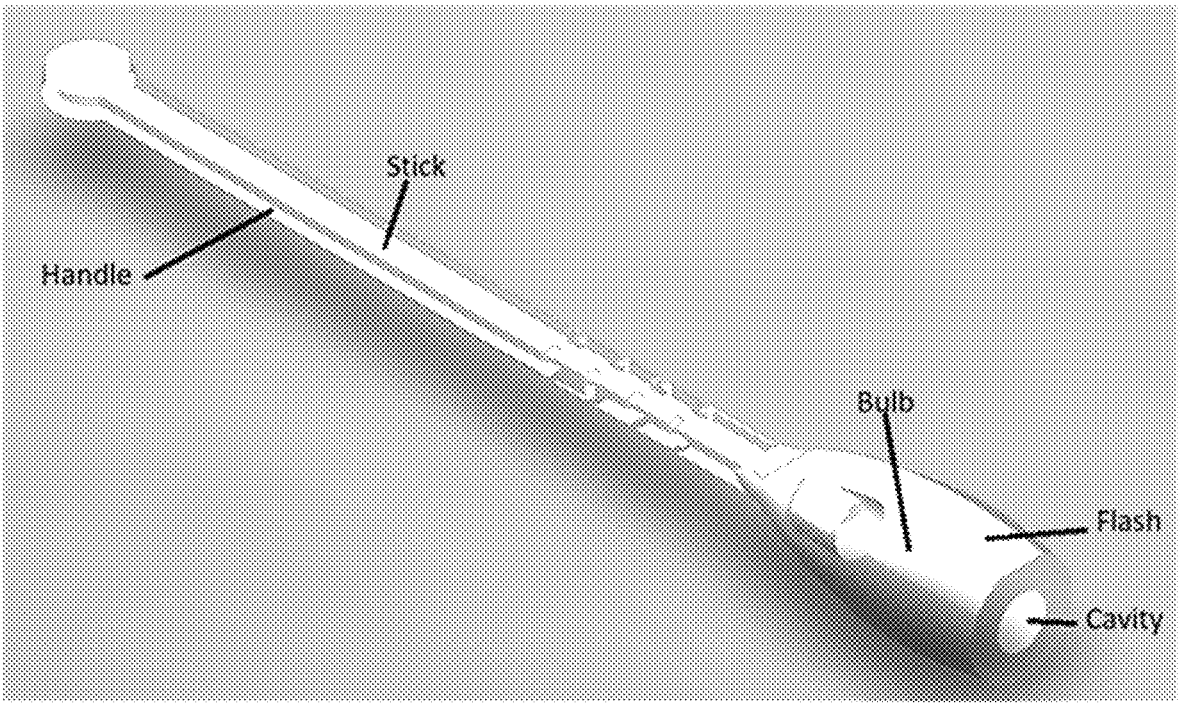
FIG. 2 shows an embodiment of the tongue strengthening device disclosed herein.
Figure 3A:
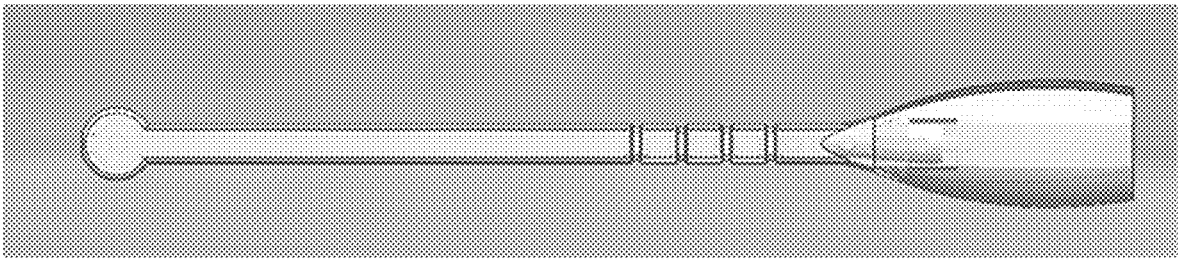
FIGS. 3A-3D show embodiments of the tongue strengthening device disclosed herein.
Figure 3B:
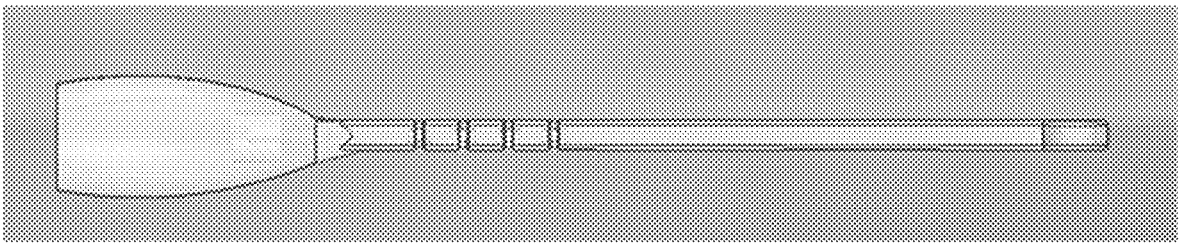
Figure 3C:
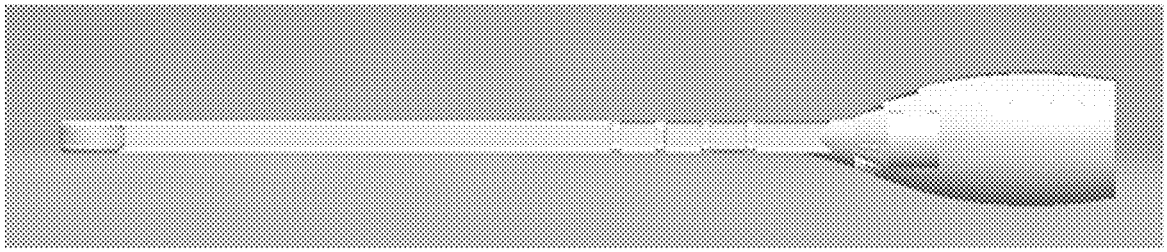
Figure 3D:
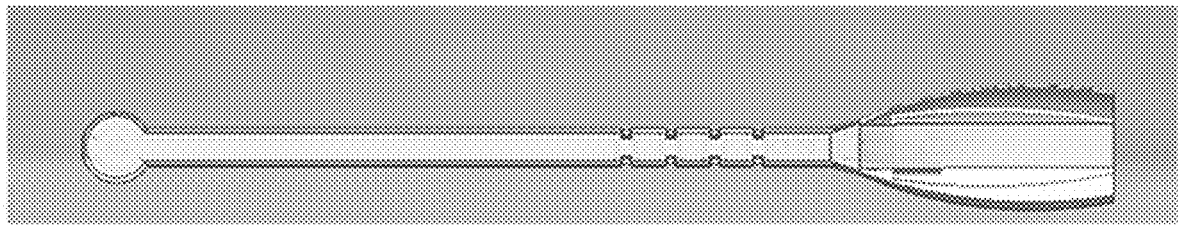

Disclosed herein, according to various embodiments, is a tongue strengthening device. Referring to FIGS. 1 and 2, the device generally includes a handle with a bulb structure at one end, according to various embodiments. The bulb is resiliently flexible, and thus the device is generally configured to enable a user to exercise their tongue by repeatedly compressing and releasing the bulb, according to various embodiments. The bulb may be made from a resiliently flexible material, such as rubber, silicone, etc.

In various embodiments, the bulb is hollow and thus defines an empty cavity. That is, the cavity of the bulb is not fluid filled but instead is empty, according to various embodiments. Accordingly, the compression dynamics of the bulb are dependent on the elasticity/flexure of the material of the bulb, the wall thickness of the bulb, and the dimensions of the cavity. In various embodiments, the tip of the bulb is open to the cavity. In various embodiments, the opening defined at the tip of the bulb has a cross-sectional shape and/or dimension that is substantially the same as the inner cross-sectional shape and/or dimension of the cavity. In various embodiments, the wall thickness of the bulb surrounding the cavity is about 0.1 millimeters. In various embodiments, the wall thickness of the bulb structure can be increased to increase the pressure/force needed to compress the bulb, dependent on the patient's tongue strength. In various embodiments, the wall thickness is the radius of the bulb, in which case the bulb is substantially solid and thus compression is not caused by inward deflection of the interior surfaces of the cavity, but instead compression of the material of the bulb itself. In various embodiments, the radius of the bulb is between about 40 millimeters and about 60 millimeters. The device overall has a subtle, discreet design with minimal form to increase user compliance. When the device is not in use, the exterior dimensions of the bulb are non-compressed.

In various embodiments, the present disclosure provides a system or kit that includes multiple tongue strengthening devices having different compression specifications. That is, according to various embodiments, the present disclosure provides a set or series of devices that each has a specific elasticity and/or compressibility rating, thus allowing a patient to graduate to devices which are harder to compress as the patient gains tongue strength. In various embodiments, the wall thickness of the bulb is the only feature that changes between the devices in a set. That is, the exterior dimensions of the respective bulbs of a set/kit may be uniform (e.g., to enable the patient to become accustomed to the shape and feel of the bulb), but the size of the cavity within the bulb may be different for each device in the set/kit. In various embodiments, the system or kit may include a single handle with replaceable bulbs of different compression strength properties. The exterior dimensions of the respective bulbs of a set/kit may be uniform but each bulb in a set/kit may have a different compression resistance. The exterior dimensions of the respective bulbs of a set/kit may be uniform but each bulb in a set/kit may have a changing compression resistance. Change in resistance between each device in the set/kit is caused by a change in the bulb's wall thickness and interior cavity geometry. In some embodiments, the device's bulb wall thickness can vary from 0.1 mm to solid. In some embodiments, the device's bulb wall thickness is about 0.1 mm. In some embodiments, the device's bulb wall thickness is about 0.9 mm. In some embodiments, the device's bulb wall thickness is about 0.1 mm-0.9 mm. The Bulb's resistance is provided by material compression. In one embodiment, the bulb is not fluid-filled and thus its functionality is not affected by puncture. In one embodiment, the bulb is partially fluid-filled. In one embodiment, the bulb is completely fluid-filled. In one embodiment, the bulb has a built-in user feedback mechanism to define extents of exercise motion (when two sides of the bulb are compressed to touching). In one embodiment, the bulb has a first side and a second side and a has a built-in user feedback mechanism to define extents of exercise motion (when the first side and second side of the bulb are compressed to touching).

Change in resistance between each device in the set/kit is caused by a change in the bulb's wall thickness or interior cavity geometry. In one embodiment, the handle is flexible. In one embodiment, the handle is over molded with silicone. In one embodiment, the handle is over molded with silicone in the handle to provide stiffness and support. The stick is stiff enough to not droop out of mouth nor sag under own weight (which would decrease user compliance because it would look odd), but flexible enough for user to slightly bend it during use, which increases the device's discreetness and subtlety and eliminates a poking hazard.

In one embodiment, the holes and/or grooves in the handle are filled with silicone and improve the pull-out strength between the bulb and the stick.

In one embodiment, the handle comprises a hole in the end of handle for attaching accessories (ID tags, hangers, etc.). In one embodiment, the handle comprises a first end and a second end and the second end comprises a hole for attaching accessories (ID tags, hangers, etc.).

Disclosed is a tongue strengthening system comprising at least a first tongue strengthening device and at least a second tongue strengthening device, wherein first tongue strengthening devices and the second tongue strengthening device comprise different elasticity and/or compressibility ratings. Disclosed is a tongue strengthening system comprising at least a first tongue strengthening device comprising a first bulb and at least a second tongue strengthening device comprising a second bulb, wherein first bulb and second bulb have the same exterior dimensions but different compressibility ratings.

Figure 4:
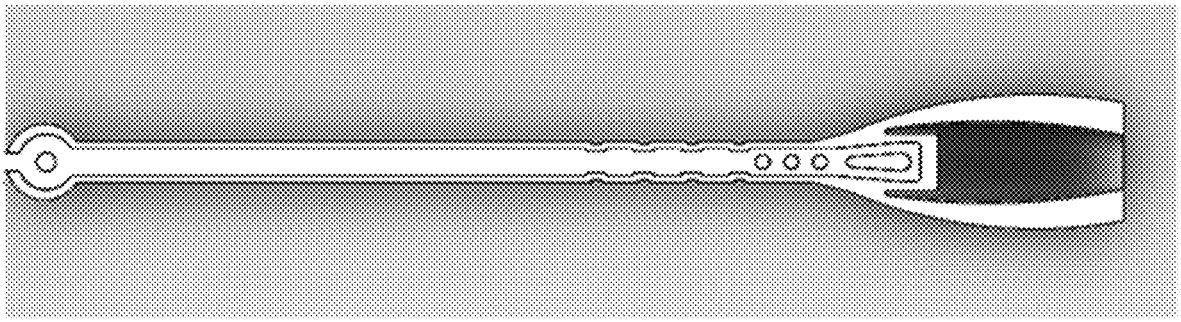
FIG. 4 shows a cross sectional view of the tongue strengthening device disclosed herein.
Figure 5A:
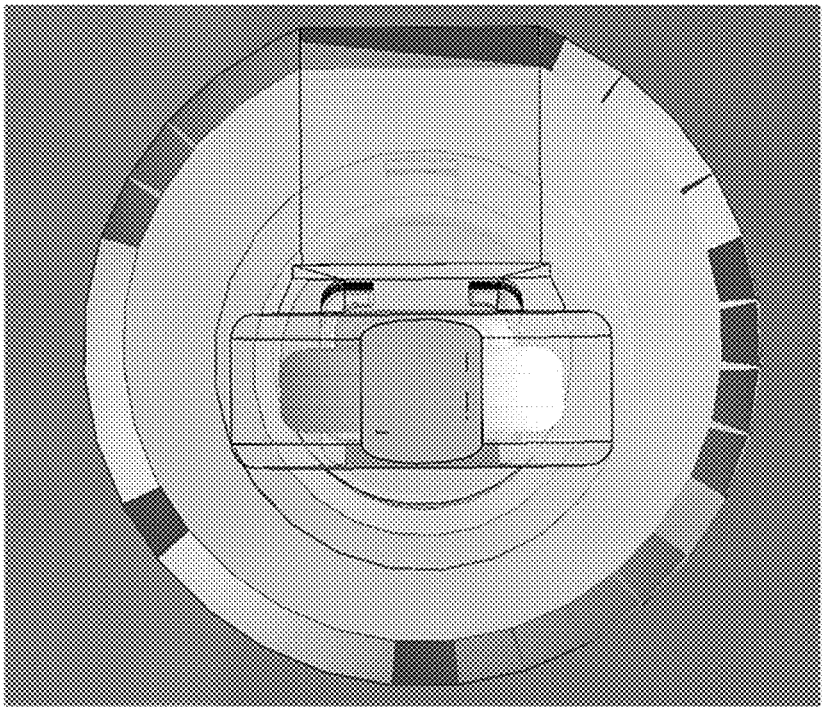
FIGS. 5A-5B show the end views of the tongue strengthening device disclosed herein.
Figure 5B:
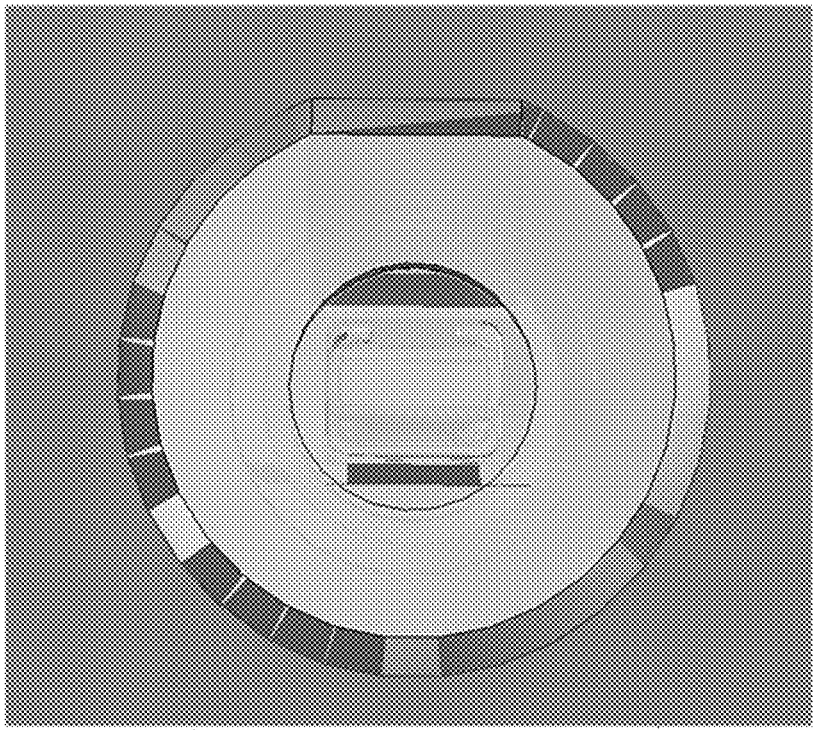
Figure 6A:
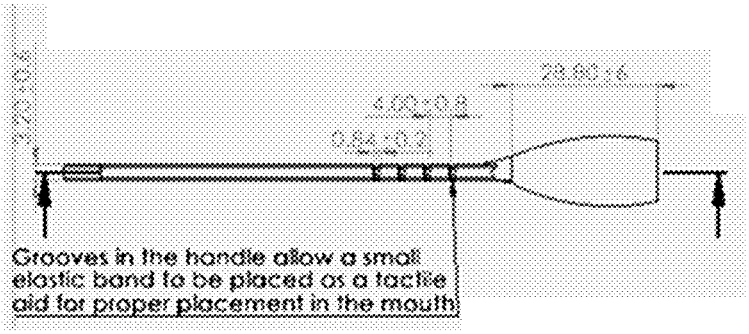
FIGS. 6A-6E show embodiments of the tongue strengthening device disclosed herein.
Figure 6B:
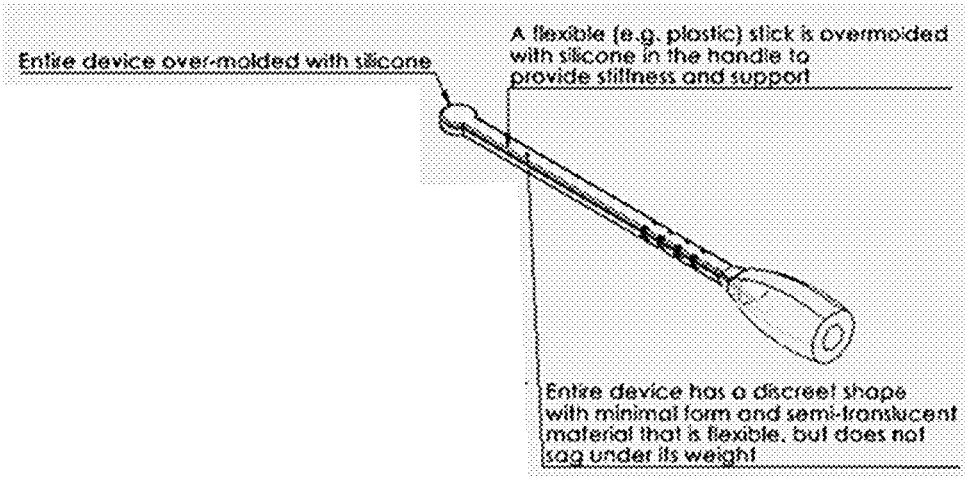
Figure 6C:
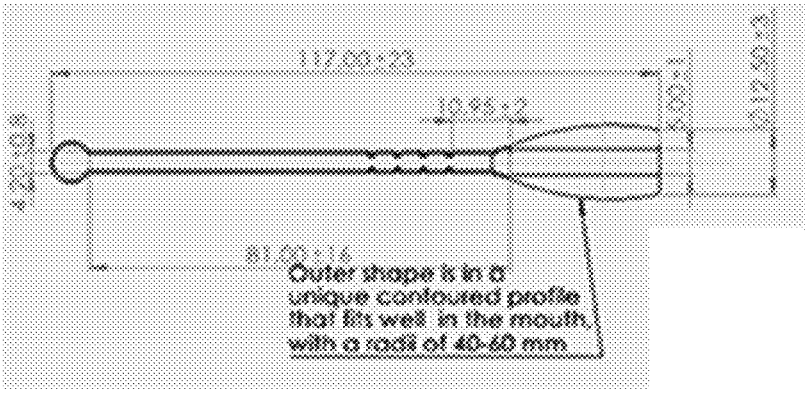
Figure 6D:
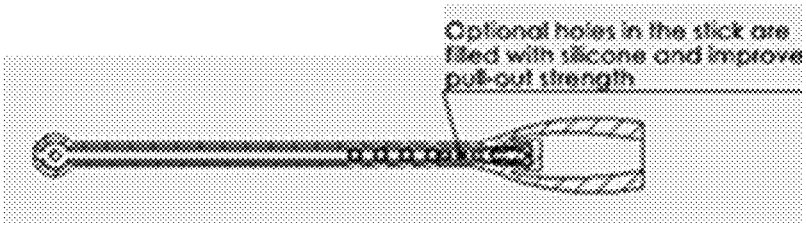
Figure 6E:
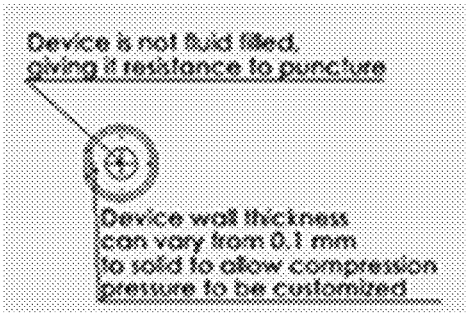

In various embodiments, the bulb may include a planar section (referred to as a "flash" in FIG. 2). This planar section may facilitate proper orientation of the bulb within a mouth of the user, and/or may facilitate proper engagement with the tongue and/or the roof of the mouth. The handle of the device may be substantially rigid. In various embodiments, the entire device (including the handle) comprises a coating of silicone or other material (e.g., the device may include a silicone over-mold). The cross-sectional view of FIG. 4 and/or the end views of FIGS. 5A and 5B show this over-molded configuration. FIGS. 6A-6E show embodiments of the tongue strengthening device disclosed herein.

In various embodiments, and with reference to FIGS. 3A-3D, the handle may define one or more grooves (either formed directly in the rigid structural material of the handle or the coating). The one or more grooves may enable a user to determine how far to insert the device into his/her mouth. In various embodiments, the device includes one or more attachments, such as rubber bands or other features that can attach to the grooves, thereby providing the user with tactile feedback regarding how far to insert the bulb-end into their mouth. In various embodiments, the device also includes one or more pass-through holes that extend transverse through the device. The over-mold or coating material may extend through these holes, thus improving the strength of the device. In various embodiments, the curvature profiles of the inner surface of the cavity and/or the outer surface of the bulb may be selected to provide desired flexibility characteristics. Grooves in the handle allow a small elastic band or similar implement to be placed as a tactile aid for proper placement in the mouth.

Benefits, other advantages, and solutions to problems have been described herein with regard to specific embodiments. However, the benefits, advantages, solutions to problems, and any elements that may cause any benefit, advantage, or solution to occur or become more pronounced are not to be construed as critical, required, or essential features or elements of the disclosure.

Reference throughout this specification to features, advantages, or similar language does not imply that all of the features and advantages that may be realized with the present disclosure should be or are in any single embodiment of the invention. Rather, language referring to the features and advantages is understood to mean that a specific feature, advantage, or characteristic described in connection with an embodiment is included in at least one embodiment of the subject matter disclosed herein. Thus, discussion of the features and advantages, and similar language, throughout this specification may, but do not necessarily, refer to the same embodiment.

Furthermore, the described features, advantages, and characteristics of the disclosure may be combined in any suitable manner in one or more embodiments. One skilled in the relevant art will recognize that the subject matter of the present application may be practiced without one or more of the specific features or advantages of a particular embodiment. In other instances, additional features and advantages may be recognized in certain embodiments that may not be present in all embodiments of the disclosure. Further, in some instances, well-known structures, materials, or operations are not shown or described in detail to avoid obscuring aspects of the subject matter of the present disclosure. No claim element is intended to invoke 35 U.S.C. 112(f) unless the element is expressly recited using the phrase "means for."

The scope of the disclosure is to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. Further, the term "plurality" can be defined as "at least two." As used herein, the phrase "at least one of", when used with a list of items, means different combinations of one or more of the listed items may be used and only one of the items in the list may be needed. The item may be a particular object, thing, or category. Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A, B, and C. In some cases, "at least one of item A, item B, and item C" may mean, for example, without limitation, two of item A, one of item B, and ten of item C; four of item B and seven of item C; or some other suitable combination.

All ranges and ratio limits disclosed herein may be combined. Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Different cross-hatching may be used throughout the figures to denote different parts but not necessarily to denote the same or different materials. Surface shading lines may be used throughout the figures to denote different parts or areas but not necessarily to denote the same or different materials. In some cases, reference coordinates may be specific to each figure. Furthermore, the connecting lines shown in the various figures contained herein are intended to represent exemplary functional relationships and/or physical couplings between the various elements. It should be noted that many alternative or additional functional relationships or physical connections may be present in a practical system.

Any reference to attached, fixed, connected or the like may include permanent, removable, temporary, partial, full and/or any other possible attachment option. Additionally, any reference to without contact (or similar phrases) may also include reduced contact or minimal contact. In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

The schematic flow chart diagrams included herein are generally set forth as logical flow chart diagrams. As such, the depicted order and labeled steps are indicative of one or more embodiments of the presented method. The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. Other steps and methods may be conceived that are equivalent in function, logic, or effect to one or more steps, or portions thereof, of the illustrated method.

Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown. Furthermore, no element, component, or method step in the present disclosure is intended to be dedicated to the public regardless of whether the element, component, or method step is explicitly recited in the claims.

The subject matter of the present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. A tongue strengthening device comprising a handle and a bulb;

wherein the bulb has a first side and a second side defining a built-in user feedback mechanism to define extents of exercise motion when the first side and second side of the bulb are compressed to touching; and wherein the handle comprises one or more grooves configured to attach rubber bands that provide a user with feedback regarding how far to insert the bulb-end into their mouth.

2. The tongue strengthening device of claim 1, wherein the handle is flexible.

3. The tongue strengthening device of claim 1, wherein the handle is overmolded with silicone.

4. The tongue strengthening device of claim 1, wherein the handle comprises one or more holes and the one or more holes are filled with silicone.

5. The tongue strengthening device of claim 1, wherein the handle comprises grooves configured to allow a small elastic band to be placed as a tactile aid for proper placement in the mouth.

6. The tongue strengthening device of claim 1, wherein the bulb has a wall thickness and the wall thickness can vary from 0.1 mm to solid.

7. The tongue strengthening device of claim 1, wherein the bulb comprises an interior cavity, the interior cavity is not fluid-filled.

8. The tongue strengthening device of claim 1, wherein the bulb comprises a built-in user feedback mechanism to define extents of motion.

9. The tongue strengthening device of claim 1, wherein the handle comprises a first end and a second and the second end comprises a hole for attaching accessories.

10. A tongue strengthening system comprising:

a plurality of tongue strengthening devices, wherein individual tongue strengthening devices of the plurality of tongue strengthening devices comprise different elasticity and/or compressibility ratings;

wherein each tongue strengthening device comprises a handle and a bulb, wherein each bulb on each tongue strengthening device in the plurality of tongue strengthening devices comprises a wall thickness and interior cavity geometry and each wall thickness and interior cavity geometry for each of the bulbs is different; and wherein each of the bulbs for each tongue strengthening device in the plurality of tongue strengthening devices has a different resistance.

11. The tongue strengthening system of claim 10, wherein the different resistance is provided by material compression.

12. A tongue strengthening system comprising:

a handle and a first bulb having a first compression strength property wherein the first bulb is configurable to be replaced with a second bulb having a second compression strength property wherein the first compression strength property and second compression strength property are different; and wherein each bulb of the first and second bulbs comprises a wall thickness and interior cavity geometry and each wall thickness and interior cavity geometry for each bulb is different; and wherein each bulb has a different resistance.

13. The tongue strengthening system of claim 12, wherein the handle is flexible.

* * * * *